United States Patent [19]

Isozaki et al.

[11] 4,396,830

[45] Aug. 2, 1983

[54] WATERPROOF KEYBOARD DEVICE

[75] Inventors: Hiromi Isozaki, Samukawa; Shuzo Kato, Hiratsuka; Satoru Sakama, Isehara, all of Japan

[73] Assignee: NCR Corporation, Dayton, Ohio

[21] Appl. No.: 408,543

[22] Filed: Aug. 16, 1982

Related U.S. Application Data

[63] Continuation of Ser. No. 211,478, Nov. 28, 1980, abandoned.

[30] Foreign Application Priority Data

Jun. 25, 1980 [JP] Japan ..... 55-85282

[51] Int. Cl.[3] ..... G06C 7/02; H01H 9/04

[52] U.S. Cl. ..... 235/145 R; 200/302

[58] Field of Search ..... 235/145 R, 145 A, 146; 174/66; 200/5 A, 159 B, 302, 309, 313, 317, 340; 220/241; 340/365 R, 365 B

[56] References Cited

U.S. PATENT DOCUMENTS

| | | | |
|---|---|---|---|
| 2,984,725 | 5/1961 | Hubbell et al. | 174/66 |
| 4,020,328 | 4/1977 | Boardman | 235/146 |
| 4,066,850 | 1/1978 | Heys, Jr. | 235/145 R |
| 4,257,555 | 3/1981 | Neel | 235/145 R |

*Primary Examiner*—Benjamin R. Fuller
*Attorney, Agent, or Firm*—J. T. Cavender; Wilbert Hawk, Jr.; Richard W. Lavin

[57] ABSTRACT

A membrane type keyboard associated with a data terminal device is disclosed which is sealed to prevent the introduction into the interior elements of the keyboard of water or other types of liquid contaminants encountered during the operation of the terminal device. The keyboard includes an outer frame member which forms an air chamber extending around the perimeter of a raised keyboard, thereby preventing any liquid spilled on the keyboard from reaching the interior elements of the keyboard. The frame member is easily removable from the keyboard, allowing the interior elements to be replaced or exchanged in accordance with the business environment in which the terminal device is to be used.

8 Claims, 5 Drawing Figures

WATERPROOF KEYBOARD DEVICE

This application is a division, of application Ser. No. 211,478, filed Nov. 28, 1980 now abandoned.

BACKGROUND OF THE INVENTION

The present invention is directed to data terminal devices and more particularly to the keyboard construction of such devices. With the development of electronic keyboards, it has been necessary to ensure that any liquid spilled on the keyboard be prevented from penetrating the various elements of the keyboard and thereby disable the operation of the terminal device. Examples of electronic keyboards that provide protection to the internal structure of the terminal device can be found in U.S. Pat. No. 4,020,328, which issued in the name of W. R. Bradam, and U.S. Pat. No. 4,066,850, which issued in the same of G. Heys, Jr., both patents assigned to the assignee of the present application. While both of such patents solve the above-cited problem with respect to the keyboard construction as disclosed in the patents, it has been found that in the case of a membrane-type electronic keyboard having a raised portion on which is located the key members there is presented problems with respect to spilled liquids that could not be solved by the teachings of the patents. In particular, it was found that liquid spilled on the surface of the terminal device entered into the interior of the keyboard due to capillary action. In the situation where the membrane keyboard includes a key indicator sheet which is replaceable to change the designation of the keys of the keyboard, the spilled liquid entered into the area between the sheet and the keyboard, thereby swelling the sheet which prevents the sheet from being easily removed from the keyboard.

It is therefore the principal object of this invention to provide an improved electronic membrane type keyboard for use in a data terminal device which will operate successfully in an environment where liquids may accidentally be spilled on the keyboard.

It is a further object of this invention to provide a waterproof keyboard which is simple in construction and therefore low in cost.

SUMMARY OF THE INVENTION

In order to fulfill these objects, there is provided a low-cost membrane type electronic keyboard assembly comprising a supporting member mounted in a terminal device having a raised supporting portion with sidewalls extending circumferentially to define the dimensions of the keyboard. Positioned on the raised supporting portion is a matrix-type keyboard member comprising a pair of printed circuit board members separated by an insulating sheet having apertures therein which define key locations enabling electronic signals to be generated upon depression of a portion of the upper surface of the keyboard member adjacent the apertures in the insulating sheet. Located on the keyboard member is a removable key-tip indicator sheet, thereby providing the location and a functional description of the key locations in the keyboard member. Mounted on the key-tip indicator sheet is a cover assembly which includes a frame member extending circumferentially around the raised supporting portion of the supporting member and is constructed to form an air chamber with the sidewall of the raised supporting portion. The air chamber extends around the circumference of the keyboard, thereby preventing any liquids from penetrating the interior of the keyboard assembly. A clear plastic sheet secured to the top of the frame member and overlying the key-tip indicator sheet enables the operator to actuate various key portions of the keyboard by depressing the appropriate key position as indicated by the key-tip indicator sheet.

BRIEF DESCRIPTION OF THE DRAWINGS

Additional advantages and features of the present invention will become apparent and fully understood from a reading of the following description taken together with the annexed drawing, in which.

DESCRIPTION OF THE PREFERRED EMBODIMENT

Figure 1:
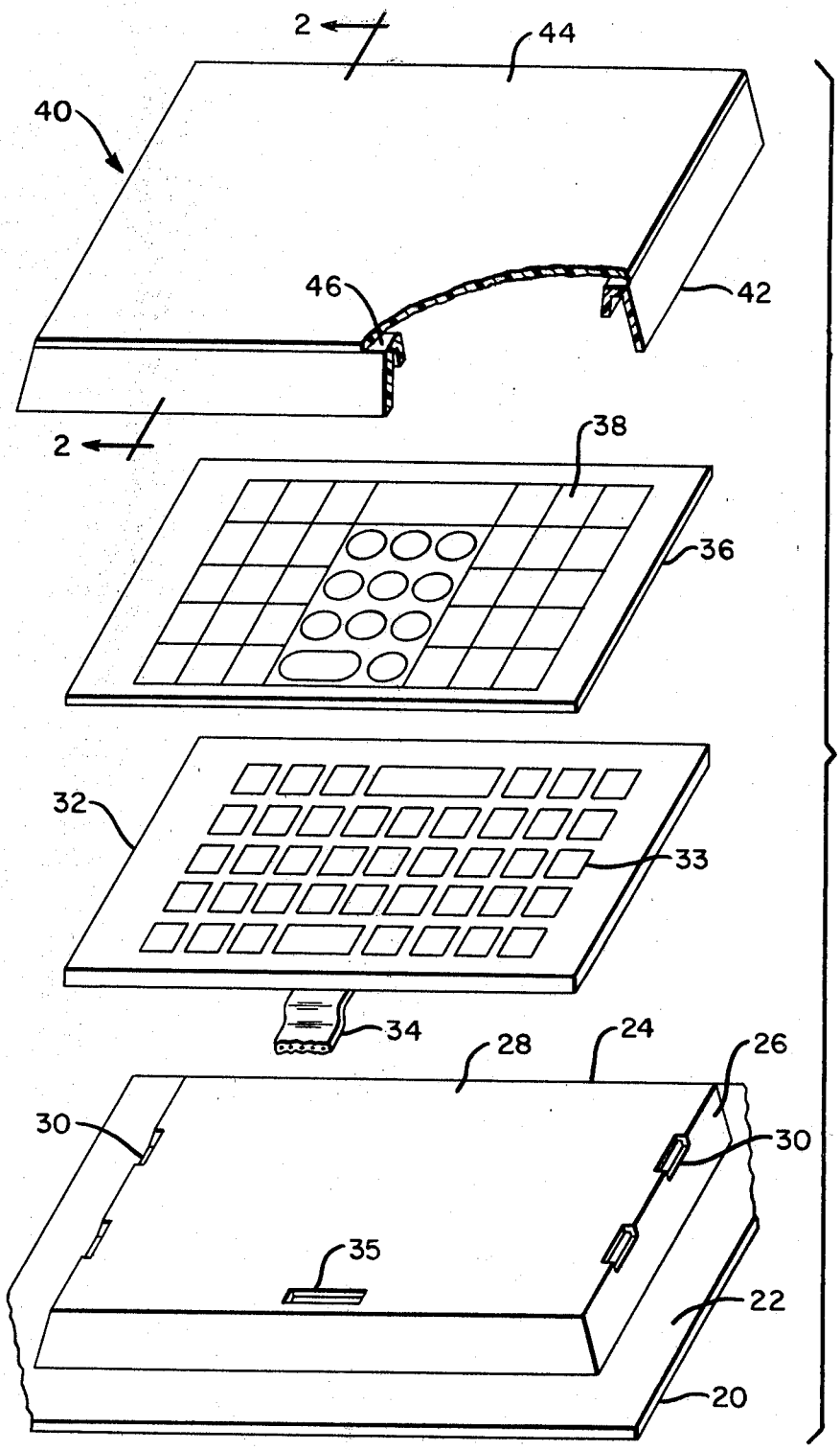
FIG. 1 is an exploded view of the keyboard assembly constructed in accordance with the present invention in which a portion of the cover assembly is broken away to show the preferred construction thereof.

Referring now to FIG. 1, there is shown an exploded view of a keyboard assembly associated with a data terminal device (not shown) in a manner that is well-known in the art. Included in the keyboard assembly is a flat supporting member 20 which is normally located in the top surface of the terminal device. The supporting member 20 includes a flat surface 22 having a centrally located raised supporting portion 24 which includes a circumferentially extending sidewall 26 and an upper flat surface 28. Oppositely located at the peripheral edge of the upper surface 28 are a plurality of mounting apertures 30 which are used to secure a cover assembly to the raised supporting portion 24 in a manner to be described more fully hereinafter.

Associated with the raised supporting portion 24 is a flat membrane-type keyboard member 32 of standard construction. An example of such a construction may be found in the previously-cited U.S. Pat. No. 4,006,850, which discloses a keyboard member comprising an upper flexible membrane having a plurality of key locations which, when depressed, will actuate a switch matrix portion thereby generating binary coded signals representing the key location depressed. These generated binary coded signals are transmitted over a cable 34 (FIG. 1) extending through an aperture 35 in the surface 28 to the terminal device for processing thereby.

Positioned on the keyboard member 32 is a replaceable key-tip indicator sheet 36 having printed thereon a plurality of key location indicia 38 corresponding to the key locations 33 in the keyboard member 32 together with key identification indicia enabling the operator to actuate the appropriate switch matrix portion of the keyboard 30 corresponding to the key required to be depressed. The keyboard member 32 and the key-tip indicator sheet 36 are assembled and mounted on the raised supporting portion 24 of the keyboard by a cover assembly generally indicated by the numeral 40 in FIG. 1 and which comprises a frame member 42 which extends circumferentially around the raised supporting portion 24 and a clear plastic sheet 44 secured to the top edge 46 of the frame member 42.

Figure 2:
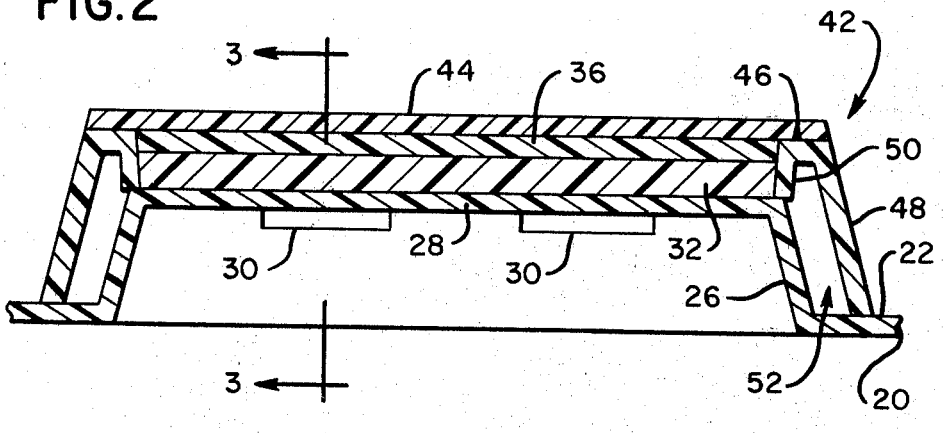
FIG. 2 is a cross-sectional view taken on lines 2—2 of FIG. 1 showing details of the air chamber and the construction of the keyboard assembly.

As best seen in FIG. 2, the frame member 42 is made of a plastic material and consists of a sloping outer wall portion 48, which slopes at the same angle as that of the sidewall 26 of the raised supporting portion 24, and a depending inner wall portion 50. The length of the depending wall portion 50 is selected to engage the surface 28 of the raised supporting portion 24 upon locating the frame member 42 on the flat surface 22 of the supporting member 20, as shown in FIG. 2. The position of the frame member 42 on the supporting member 20 enables the frame member wall portions 48 and 50 to form an air chamber generally indicated by the numeral 52 with the sidewall 26 of the raised supporting portion 24, thereby preventing any liquid spilled on the surface 22 of the supporting member 20 from splashing or otherwise coming into contact with the keyboard member 32 or the key-tip indicator sheet 36. It will be seen from FIG. 2 that the keyboard member 32 and the indicator sheet 36 are orientated on the surface 28 of the raised supporting portion 24 by the inner wall portion 50 of the frame member 42.

Figure 3:
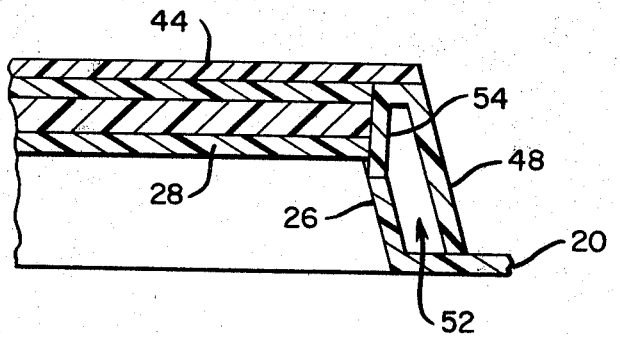
FIG 3 is a partial cross-sectional view taken on lines 3—3 of FIG. 2 showing details of the mounting structure of the cover assembly on the raised portion of the supporting member.

The frame member 42 also includes a plurality of inner wall portion extensions 54 (FIG. 3) which are part of the inner wall portion 50 of the frame member 42. The wall portion extensions 54 are located to releasably engage the apertures 30 (FIGS. 1 and 2) in the raised supporting portion 24, thus locating and removably securing the cover assembly 40 to the supporting portion 24 of the keyboard assembly.

When assembling the keyboard, the keyboard member 32 and the key-tip indicator sheet 36 are positioned on the surface 28 of the raised supporting portion 24 with the electrical cable 34 extending from the keyboard member 32 (FIG. 1) and through the aperture 35 located in the surface 28 of the raised supporting portion 24 where it is connected to the terminal device allowing the electrical signals generated by the operation of the keyboard member 32 to be processed by the terminal device. After positioning the keyboard member 32 and the key-tip indicator sheet 36 on the raised supporting portion 24, the cover assembly 40 is mounted on the raised supporting portion 24 by locating the wall portion extensions 54 (FIG. 3) of the frame member 42 within the apertures 30, thereby locating the frame member on the assembled key tip indicator sheet 36 and the keyboard member 32 and forming the air chamber 52 which surrounds the raised supporting portion 24 of the supporting member 20. It will be seen that this arrangement prevents any liquids spilled on the cover assembly 40 or on the supporting member 20 from penetrating the key-tip indicator sheet 36 or the keyboard member 32. When the key-tip indicator sheet 36 is required to be changed in order to change the functional operation of the keyboard, it will be apparent that this can easily be accomplished by merely removing the cover assembly 40 and placing a new key-tip indicator sheet 36 on the keyboard member 32 in a manner that is well-known in the art.

Figure 4:
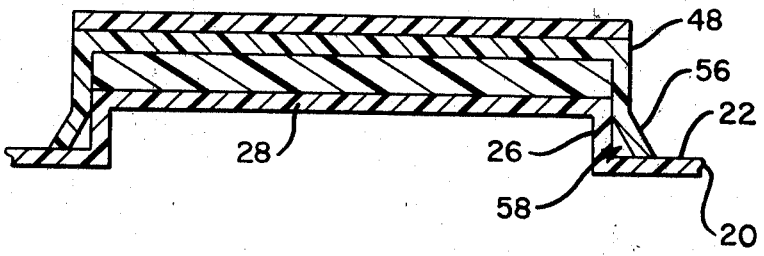
FIG. 4 is a cross-sectional view of a second embodiment of the keyboard constructed in accordance with the present invention.
Figure 5:
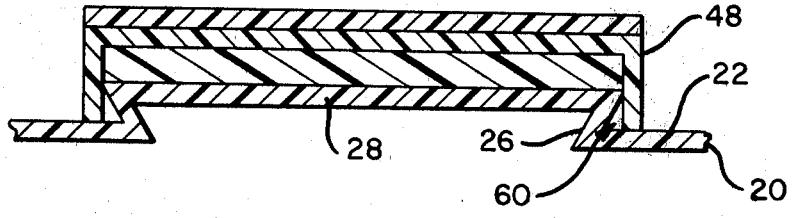
FIG. 5 is a cross-sectional view of a third embodiment of the keyboard constructed in accordance with the present invention.

Referring now to FIGS. 4 and 5, there are shown several different embodiments of the keyboard. In FIG. 4, the sidewall 26 of the raised supporting portion 24 is vertically orientated with respect to the surface 22 of the supporting member 20, thereby forming an air chamber 58 with an inclined off-set portion 56 of the vertically orientated sidewall portion 48 of the frame member 42. In FIG. 5, the air chamber 60 is formed by the inwardly extending sidewall 26 of the raised supporting portion and the vertically orientated sidewall portion 48 of the frame member 42.

From the construction of the air chamber 52 (FIG. 2) which extends circumferentially around the raised supporting portion 24 of the supporting member 20, shown and described herein, it is obvious that the spilling of liquids on the supporting member 20 or on the cover assembly 40 (FIG. 1) will not interfere with the operation of the keyboard. If any liquids do penetrate the air chamber surrounding the keyboard, merely removing the cover assembly 40 from the raised supporting portion 24 allows for the removal of liquids in addition to replacing the key-tip indicator sheet 36 if the latter is required. It is further obvious that these operations will occur in a minimum of time, thereby providing very little interruption in the operation of the data terminal device.

While the principles of the invention have now been made clear, it will be obvious to those skilled in the art that many modifications of structure, arrangements, elements and components can be made which are particularly adapted for specific environments without departing from those principles. Thus it is obvious that in attaching the cover member 40 to the raised portion 24 of the supporting member 20 other well-known fastening means such as screw members and the like may be employed. In addition, the cover sheet 44 may incorporate raised key-tip portions to simulate regular key tips to improve the tactile feel of the keyboard. The appended claims are therefore intended to cover and embrace any such modification within the limits only of the true spirit and scope of the invention.

We claim:

1. A membrane-type keyboard apparatus comprising:

a supporting member having a raised portion comprising a first planar surface contiguous with a circumferentially orientated depending first side wall portion engaging a second planar surface surrounding said first side wall portion;

a keyboard assembly located on said first planar surface for generating signals in response to the actuation of key representing portions of said keyboard assembly;

and cover means mounted on said keyboard assembly including a third planar surface engaging said keyboard assembly and having a second side wall circumferentially surrounding said first side wall portion, said second side wall engaging an upper portion of said first side wall portion and extending away from the remaining portion of said first side wall portion to engage said second planar surface forming with said first side wall portion and said second planar surface an air chamber extending circumferentially around said keyboard assembly thereby preventing any liquid located on said second planar surface from reaching said keyboard assembly.

2. The keyboard apparatus of claim 1 in which said second side wall includes a depending third side wall portion located adjacent said second wall and engaging said first side wall portion whereby said second side wall and said first and third side wall portions form said air chamber with said planar surface thereby preventing any liquids from reaching said keyboard assembly.

3. The keyboard apparatus of claim 2 which further includes a replaceable key indicia bearing sheet member positioned on said keyboard assembly engaging said third side wall portion for locating the key representing portions of said keyboard assembly, and said cover means includes means for releasably mounting said cover means to said raised portion whereby upon removal of said cover member said indicia bearing sheet member may be replaced by another indicia bearing sheet member.

4. The keyboard apparatus of claim 1 in which said second side wall includes a vertical extending portion engaging said first side wall portion and an off-set portion engaging said second planar surface whereby said first side wall portion, said off-set portion and said planar surface form said air chamber which prevents any liquids from reaching said keyboard assembly.

5. The keyboard apparatus of claim 1 in which said first side wall portion extends inwardly toward engagement with said second planar surface and wherein the second side wall of said cover means extends in a vertical direction engaging said first side wall portion and the second planar surface thereby forming with said first side wall portion and said second planar surface said air chamber which prevents any liquids from reaching said horizontal keyboard assembly.

6. The keyboard apparatus of claim 2 in which said raised portion includes a plurality of oppositely positioned apertures located along the periphery of said first planar surface and said third side wall portion includes a plurality of mounting portions which are positioned in said apertures for releasably securing the cover assembly to the raised portion of the supporting member.

7. A membrane-type keyboard apparatus comprising:

a support member having a raised portion comprising a first planar surface contiguous with a circumferentially orientated depending first side wall portion engaging a second planar surface surrounding said first side wall portion;

a keyboard assembly located on said first planar surface for generating signals in response to the actuation of key representing portions of said keyboard assembly;

a replaceable indicia bearing member positioned on said keyboard assembly for locating the key portions of said keyboard assembly;

and a cover assembly positioned on said indicia bearing member including a third planar surface engaging said indicia bearing member and a second side wall circumferentially surrounding said first side wall portion and engaging said keyboard assembly and said indicia bearing member, said second side wall includes a depending third side wall portion engaging the upper portion of said first side wall portion and a fourth side wall portion spaced from said third side wall portion and extending away from the lower portion of said first side wall portion to engage said second planar surface forming with said first and third side wall portions and said second planar surface an air chamber extending continuously around said keyboard assembly thereby preventing any liquid located on said second planar surface from reaching said keyboard assembly.

8. The keyboard apparatus of claim 7 in which the upper edge of said first side wall portion includes a plurality of oppositely positioned apertures and said third side wall portion a plurality of depending mounting portions which are positioned in said apertures for releasably securing the cover assembly to the raised portion of the support member.

* * * * *